US005343221A

United States Patent [19]

Arakawa et al.

[11] Patent Number: 5,343,221

[45] Date of Patent: Aug. 30, 1994

[54] POWER SUPPLY APPARATUS USED FOR DRIVING LIQUID-CRYSTAL DISPLAY AND CAPABLE OF PRODUCING A PLURALITY OF ELECTRODE-DRIVING VOLTAGES OF INTERMEDIATE LEVELS

[75] Inventors: Takashi Arakawa, Nagoya; Hiroyuki Motegi, Kawasaki, both of Japan

[73] Assignee: Kabushiki Kaisha Toshiba, Kawasaki, Japan

[21] Appl. No.: 82,429

[22] Filed: Jun. 25, 1993

Related U.S. Application Data

[63] Continuation of Ser. No. 769,838, Oct. 2, 1991, abandoned.

[30] Foreign Application Priority Data

Oct. 5, 1990 [JP] Japan ..... 2-266365

[51] Int. Cl.[5] ..... G09G 3/00

[52] U.S. Cl. ..... 345/211; 345/87

[58] Field of Search ..... 340/784, 811, 765, 805, 340/813; 359/55, 84, 85; 307/246, 268, 261, 296.6; 345/211, 212, 213, 87, 94, 95

[56] References Cited

U.S. PATENT DOCUMENTS 4,050,064 9/1977 Hashimoto et al. ..... 340/811
4,769,639 9/1988 Kawamura et al. .
4,781,437 11/1988 Shields et al. ..... 340/784
4,859,870 8/1989 Wang et al. ..... 307/264

FOREIGN PATENT DOCUMENTS 0314084 5/1989 European Pat. Off. .

*Primary Examiner*—Richard Hjerpe
*Assistant Examiner*—Chanh Nguyen
*Attorney, Agent, or Firm*—Oblon, Spivak, McClelland, Maier & Neustadt

[57] ABSTRACT

A plurality of resistors serially connected with each other between a maximum voltage level "V" and a minimum voltage level "0" are provided to generate voltage-divided intermediate voltage levels "V2H", "V1H", "V3L", "V2L", the voltages having the voltage-divided intermediate voltage levels being supplied to a first group of operational amplifiers whose first stage input portions are formed of N-channel MOSFETs and a second group of operational amplifiers whose first stage input portions are formed of P-channel MOSFETs. Frame signal FR for alternating-current-driving a liquid crystal display device is supplied to the operational amplifiers. When signal FR is in a state "0", the first group of operational amplifiers are brought into an active state while the second group is brought into an inactive state. When signal FR is in a state "1", the first group of operational amplifiers are inactive. Under the condition that power down signal PD for non-use of the liquid crystal display device is generated, all of the operational amplifiers are controlled to be in an inactive state.

8 Claims, 7 Drawing Sheets

| FR | V1 | V2 | V3 |
|---|---|---|---|
| 0 | V1H ( $=\frac{3}{5}$ V) | V2H( $=\frac{4}{5}$ V) | V |
| 1 | 0 | V2L( $=\frac{1}{5}$ V) | V3L( $=\frac{2}{5}$ V) |

POWER SUPPLY APPARATUS USED FOR DRIVING LIQUID-CRYSTAL DISPLAY AND CAPABLE OF PRODUCING A PLURALITY OF ELECTRODE-DRIVING VOLTAGES OF INTERMEDIATE LEVELS

This application is a continuation of application Ser. No. 07/769,838, filed on Oct. 2, 1991, now abandoned.

BACKGROUND OF THE INVENTION

1. Field of the Invention

The present invention relates to a liquid crystal display device driven by an alternating current, especially to a power source apparatus which is used for driving a liquid crystal display device and has four intermediate potentials between a maximum potential and a minimum potential.

2. Description of the Related Art

A liquid crystal display device has an arrangement of a plurality of display dots, which are formed of cross points of a group of segment electrodes and a group of common electrodes. The liquid crystals between the two groups of electrodes are controlled in their crystal arrangement by means of potential difference between the groups of segment electrodes and the group of common electrodes in order to display images.

Such a liquid crystal display device uses a dynamic driving control in which potentials set between the segment electrodes and the common electrodes are generally reversed in polarity for each frame. For such a dynamic driving control, there are generally prepared power sources for providing four intermediate potential levels in addition to a maximum potential power source and a minimum potential power source, the intermediate potential levels being obtained by dividing the potential difference between the maximum potential level and the minimum potential level into four parts. A power source having a suitable potential level is selected in accordance with a display data, and the voltage obtained by the selected potential power source is delivered and applied to the group of segment electrodes and the group of common electrodes.

The four intermediate potential levels between the potential levels set by the maximum potential power source and the minimum potential power source are generated by a voltage dividing circuit which is formed by a combination of resistors.

FIG. 8 shows a conventionally known power source circuit for driving a liquid crystal display device. This power source circuit is arranged such that any one of terminals V1, V2, and V3 supplies, corresponding to frame signal FR, a power source output having a predetermined potential for A.C.-driving a liquid crystal display device.

For instance, as apparent from the relationship shown in FIG. 9 and the timing chart shown in FIG. 12, the maximum potential level "V", the two intermediate levels "V2H" and "V1H", and the minimum potential level "0" are put out when frame signal FR is "0", whereas, when frame signal FR is "1", the maximum potential level "V", the two intermediate potential levels "V3L" and "V2L", and the minimum potential level "0" are put out. These potential level combinations are alternately generated whenever the frame signal changes between "0" and "1". These potential signals are supplied through the segment output level selecting circuit shown in FIG. 10 and the common output level selecting circuit shown in FIG. 11 to the segment electrodes and the common electrodes of the liquid crystal display device.

FIG. 8 shows a 1/5 pre-biased power source circuit, in which resistors R1 and R4 are each set to 300 KΩ, resistors R2 and R3 to 100 KΩ, resistors r1 and r4 to 30 KΩ, and resistors r2 and r3 to 10 KΩ. The dynamic chart shown in FIG. 12 shows a case of a $\frac{1}{8}$ duty in which the number of common outputs is eight. The figure exemplary shows only one segment output among a plurality of segment outputs and only one common output among a plurality of common outputs.

In such a power source circuit, clock signal $\phi c$ formed of a pulse signal indicating a common selection signal switching timing, and lowers the output resistance of the potential dividing circuit at a moment of a common signal switching time so as to increase the response of the liquid crystals. Namely, the charging or discharging time of a capacitance provided in the liquid crystal display device is made short by connecting resistors r1–r4, which are lower in resistance value than resistors R1–R4, in parallel with resistors R1–R4 for dividing voltage V.

However, a large capacitance is required for a liquid crystal display device having a large number of display pixels. Therefore, the output resistance of the voltage dividing circuit must be made sufficiently small, or a satisfactory display quality may not be obtained. However, if the output resistance of the voltage dividing circuit is made small, the problem of increase in power consumption will occur.

FIG. 13 shows a circuit for making small the output resistance of the intermediate potential level power sources. In this circuit, operational amplifiers OP1 through OP4 are used to put out the voltages which are voltage-divided by resistors R1–R5. This circuit shows a 1/5 pre-biased case, and resistors R1–R5 are made of resistance element having a same resistance value. However, in such a circuit which uses operational amplifiers, operational amplifiers OP1–0P4 are always set in active condition, so that the power consumption at the operational amplifier portion is large.

SUMMARY OF THE INVENTION

The object of the present invention is to provide a power source apparatus for driving a liquid crystal display device, in which the output resistance of its voltage dividing circuit can be set sufficiently small, and an image display having a good display quality may be realized.

Another object of the present invention is to provide a power source apparatus in which the output resistance may be set sufficiently small, and the power consumption at the voltage dividing circuit portion will surely be reduced.

In a power source apparatus for driving a liquid crystal display device in the present invention, the power source voltages with a plurality of voltage difference levels set by a voltage dividing circuit formed by a resistor circuit are put out through the operational amplifiers, the operational amplifiers being selectively rendered to be in an inactive state in accordance with frame signals.

The plural operational amplifiers, which are arranged for providing the plural intermediate potential levels and form the driving power source device, are selectively rendered to be in an inactive state in a period of time when a potential having a potential level corresponding to any one of the operational amplifiers is not used as a liquid crystal driving power source, so that the electric current for operating the operational amplifier reduces. In addition, the presence of the operational amplifiers assures the reduction in output resistance, and the liquid crystal display device will be kept good in quality.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
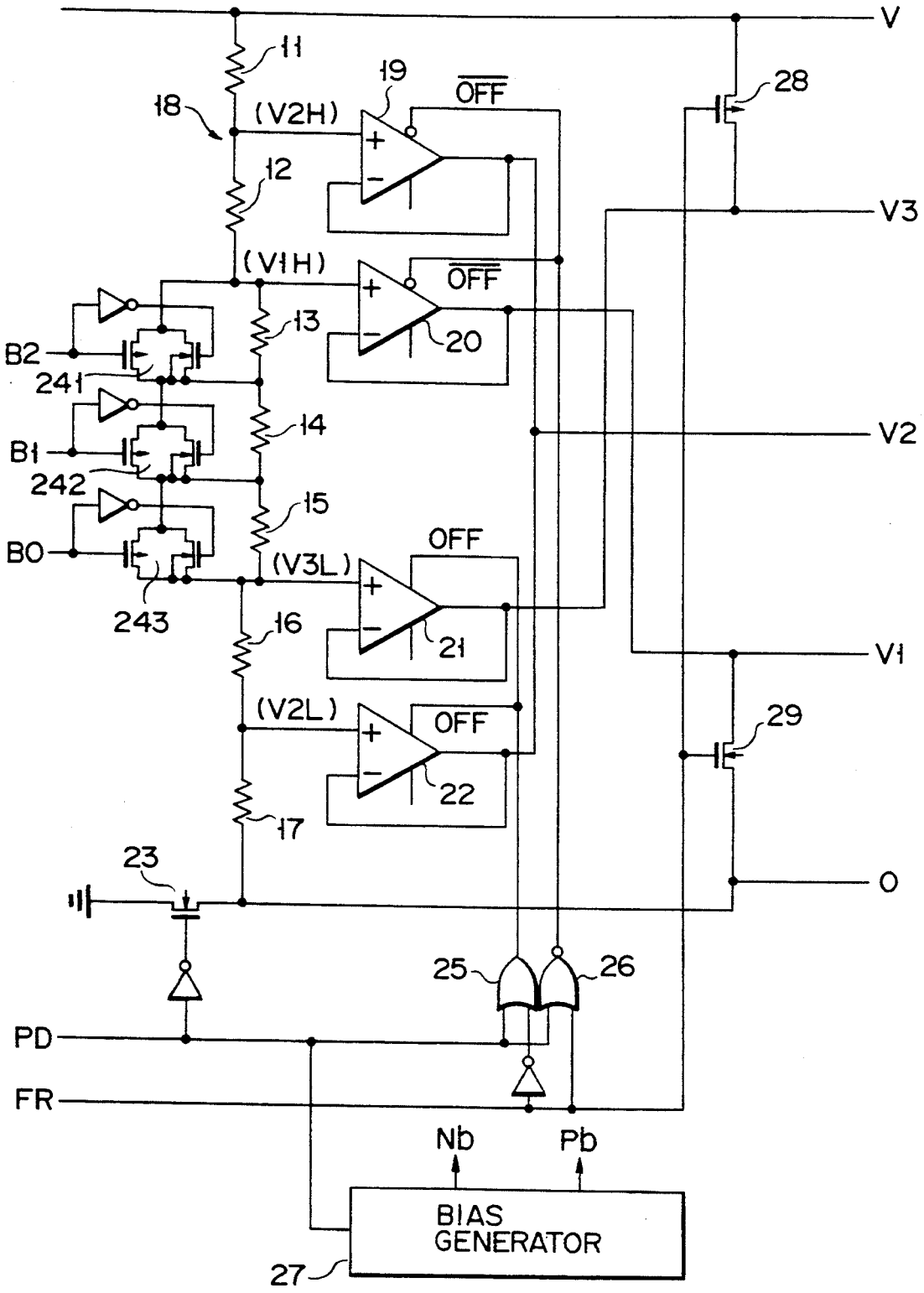
FIG. 1 is a circuit diagram of one embodiment of the present invention for explaining a power source apparatus for driving a liquid crystal display device.
Figure 10:
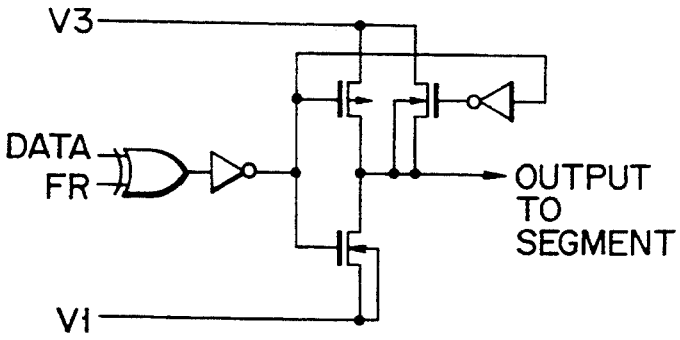
FIG. 10 (PRIOR ART)
FIG. 10 and FIG. 11 respectively show circuit examples of a liquid crystal driving portion into which driving power source voltage is supplied.
Figure 11:
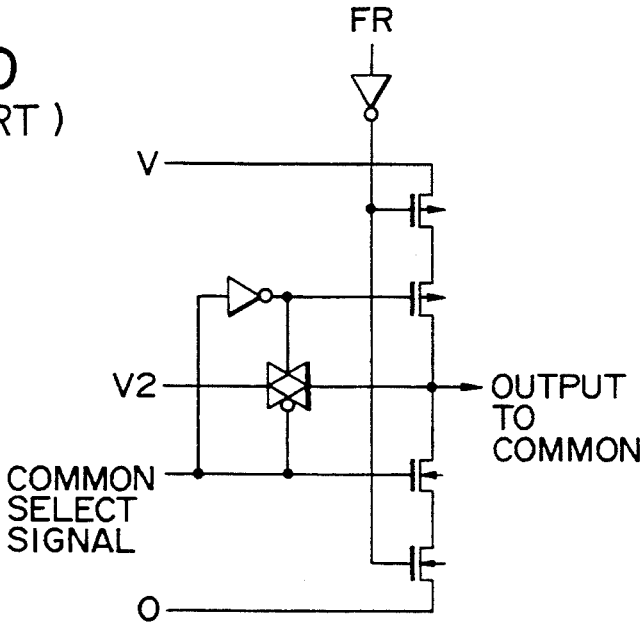
FIG. 11 (PRIOR ART)

The embodiment shown in FIG. 1 is a power source circuit which is formed of a C-MOS integrated circuit and is applied to a driving device which is incorporated in a one-chip micro computer to drive a liquid crystal display device of the computer. Voltages having different intermediate levels generated by the power source circuit are respectively put out from points V3, V2 and V1. The voltages put out of points V1 and V3 are supplied to a segment output level selecting circuit shown in FIG. 10, whereas the voltage put out of point V2 is supplied to a common output level selecting circuit shown in FIG. 11.

Between a highest potential power source line to which a highest potential V is set and a lowest potential power source line to which a lowest potential 0 is set is connected a voltage dividing circuit 18 which is formed by serially connecting resistors 11 and 12, resistors 13–15, and resistors 16 and 17. A voltage having a voltage level "V2H" is put out of a connecting point between resistors 11 and 12, a voltage having a voltage level "V1H" is put out of a connecting point between resistors 12 and 13, a voltage having a voltage level "V3L" is put out of a connecting point between resistors 15 and 16, and a voltage having a voltage level "V2L" is put out of a connecting point between resistors 16 and 17. These voltage outputs are respectively supplied to operational amplifiers 19 to 22. Outputs from operational amplifiers 19 and 22 are put out as voltage V2, an output from operational amplifier 20 is put out as voltage V1, and an output from operational amplifier 21 is put out as voltage V3. The lowest potential power source line is grounded through N-channel MOS transistor 23.

Resistors 13 to 15 are treated as one group. They respectively have parallel connected analogue switching circuits 241 to 243 which are ON-OFF controlled by signals B0 to B2. A composite resistance value of resistors 13 to 15 is set by signals B0 to B2. Signals B0 to B2 are each an output of a processor portion, not shown in any of the drawings, and pre-bias values to be supplied to liquid crystals may be set by a program.

Figure 2:
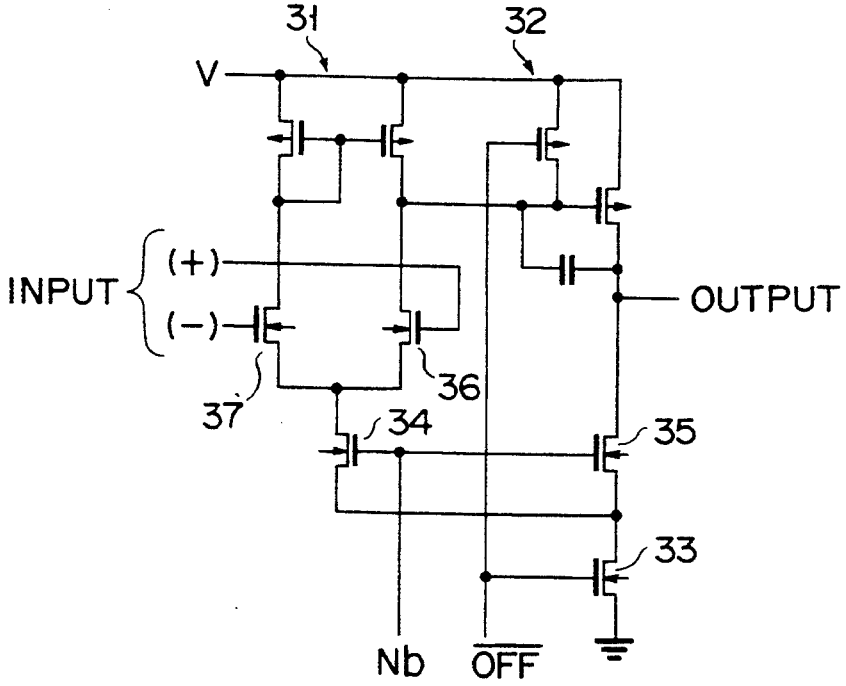
FIG. 2 and FIG. 3 are circuit diagrams for showing concrete examples of an operational amplifier which is a constituent of the above power source device.
Figure 3:
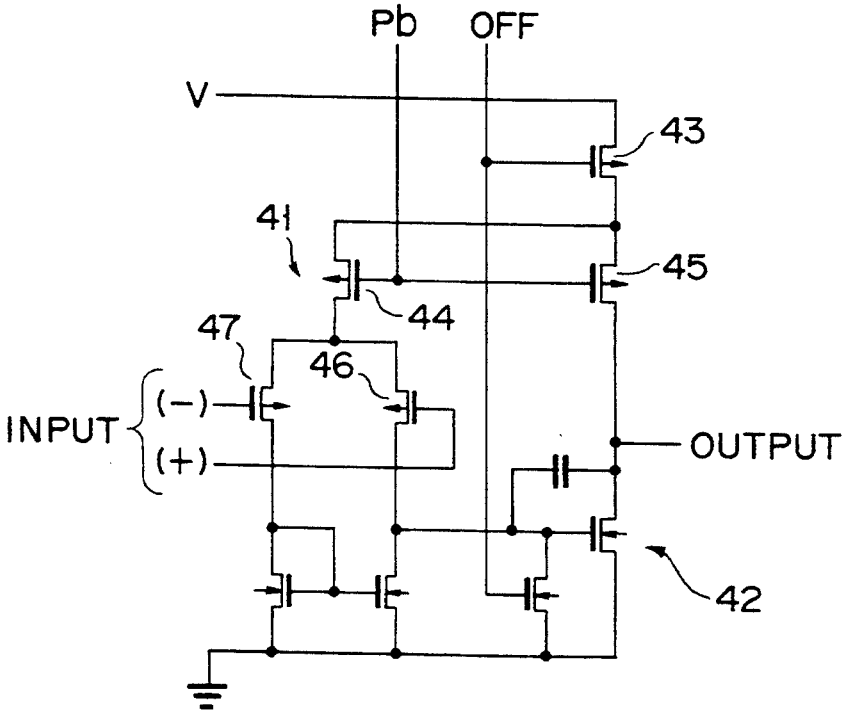

Operational amplifiers 19 and 20 are constructed such that an N-channel MOSFET is used at their respective first stage input portion. Operational amplifiers 21 and 22 are constructed such that a P-channel MOSFET is used at their respective first stage input portion. FIG. 2 shows a circuit of an exemplary embodiment for each of operational amplifiers 19 and 20. FIG. 3 shows a circuit of an exemplary embodiment for each of operational amplifiers 21 and 22.

Each of operational amplifiers 19 to 22 has an OFF-signal input terminal, and is rendered to be in an inactive state, where its power consumption becomes zero, by a signal supplied to the OFF-signal input terminal. When the operational amplifiers are rendered to be in the inactive state, their output terminals become high in impedance.

Each of operational amplifiers 19 to 22 has a voltage follower structure in which its output returns to the inverted side (−) input terminal. When these operational amplifiers are in an active state, the voltage level applied to their non-inverted side (+) input is put out as a low output impedance.

The operational amplifier shown in FIG. 2 as an example of each of operational amplifiers 19 and 20 has differential stage 31 and output stage 32, and its electric current is cut off by transistor 33. Its first stage input portion is formed of N-channel MOSFETs 36 and 37. The operational amplifier shown in FIG. 3 as an example of each of operational amplifiers 21 and 22 also has differential stage 41 and output stage 42, and its electric current is cut off by transistor 43. Its first stage input portion is formed of P-channel MOSFETs 46 and 47.

Figure 4:
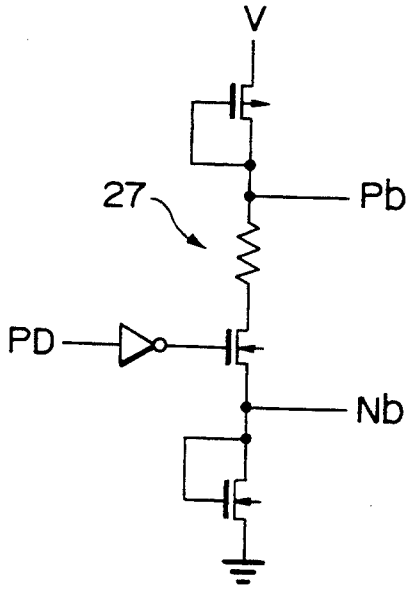
FIG. 4 is a circuit diagram for showing concrete example of a bias voltage generator which is a constituent of the above power source device.

Bias voltage generator 27 generates N-bias voltage Nb and P-bias voltage Pb. It supplies gate bias voltage Nb to N-channel transistors 34 and 35, both of which contribute to a constant current operation in the inside of the operational amplifier shown in FIG. 2 as an example of each of operational amplifiers 19 and 20. It also supplies gate bias voltage Pb to P-channel transistors 44 and 45, both of which contribute to a constant current operation in the inside of the operational amplifier shown in FIG. 3 as an example of each of operational amplifiers 21 and 22. FIG. 4 shows an exemplary embodiment of bias voltage generator 27.

The processor which is not shown in any of the drawings generates power down signal PD for controlling a display power source. Power down signal PD is supplied to the power source circuit shown in FIG. 1. When power down signal PD is "1", N-channel transistor 23 is cut off, and first to fourth operational amplifiers 19 to 22 are rendered to be in an inactive state by means of OR-gate 25 and NOR-gate 26. When power down signal PD is further supplied to bias voltage generator 27, power consumption in generater 27 will be reduced, so that the power consumed by the liquid crystal driving circuit will be reduced.

Power down signal PD becomes "1" under the condition that a display function is not used in the liquid crystal display device. Power consumption in the display system therefore will be reduced by signal PD.

In voltage dividing circuit 18, the resistance value of each of resistors 11, 12, 16 and 17 is set to be R, and the composite resistance value of resistors 13 to 15 is denoted by r. Intermediate voltage levels supplied to non-inverted side (+) input terminals of operational amplifiers 19 to 22 are denoted by "V2H", "V1H", "V3L" and "V2L". Then intermediate voltage levels may be expressed as follows:

$$V2H = \{(3R + r)/(4R + r)\} \cdot V$$
$$V1H = \{(2R + r)/(4R + r)\} \cdot V$$
$$V3L = \{(2R)/(4R + r)\} \cdot V$$
$$V2L = \{R/(4R + r)\} \cdot V$$

The value of the pre-bias may be expressed as follows:

$$\{R/(4R+r)\} \cdot V$$

In the embodiment, "R=200 KΩ", and resistors 13 to 15 are respectively set to 400 KΩ, 200 KΩ and 100 KΩ. An ON-resistance of each of analogue switches 241 to 243 for short-circuiting resistors 13 to 15 is set sufficiently smaller than the resistance values of resistors 13 to 15, so that it is possible to consider it "0". Therefore, the composite resistance value r of resistors 13 to 15 may be selected from "0Ω", where signals B0 to B2 are all in a "0" level, to 700 KΩ, where signals B0 to B2 are all in a "1" level, and may be fixed to the selected value. Namely, it is possible to select a pre-bias value from V/4 to V/7.5.

Frame signal FR is a signal for making the liquid crystal application voltage into an alternating current, and an alternating signal having a duty ratio of ½ is supplied when power down signal PD is "0".

During a period when frame signal FR is "1", first and second operational amplifiers 19 and 20 are rendered to be in an inactive state, whereas third and fourth operational amplifiers 21 and 22 are set to be in an active state. In this condition, P-channel transistor 28 is cut off, and N-channel transistor 29 is turned on. Therefore, output V1 has a "0" level, V2 has voltage level "V2L", and V3 has voltage level "V3L".

In contrast, during a period when frame signal FR is "0", first and second operation amplifiers 19 and 20 are set to an active state, whereas third and fourth operational amplifiers 21 and 22 become an inactive state. P-channel transistor 28 is turned on, and N-channel transistor 29 is cut off. Therefore, terminal V1 puts out voltage level "V1H", V2 puts out level "V2H", and V3 puts out level "V".

Figure 5:
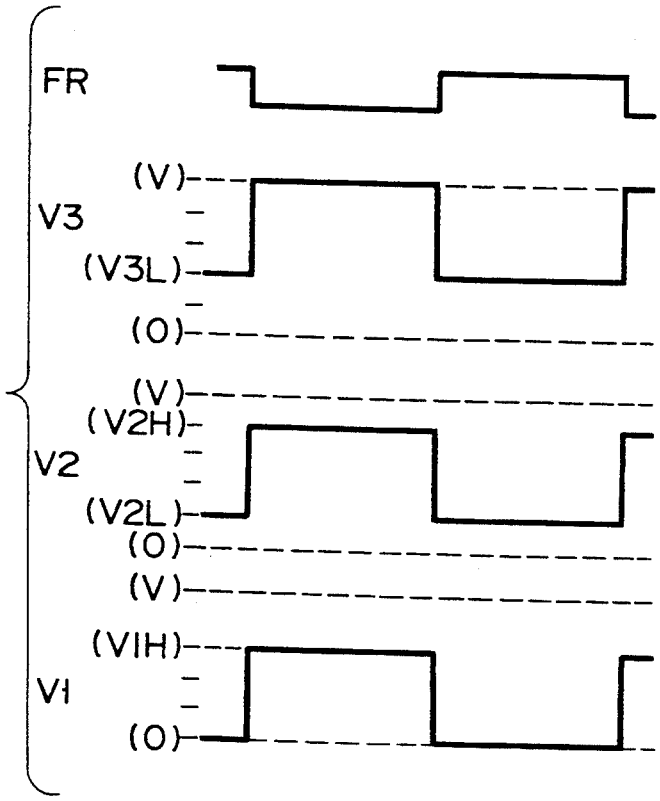
FIG. 5 is a diagram of signal waveforms for explaining the operation condition of the above power source device.

The relationship between frame signal FR and terminals V1 to V3 is shown in FIG. 5. In the example shown in FIG. 5, resistance value R for resistors 11, 12 and resistors 16, 17 is set to be equal with composite resistance value r of resistors 13 to 15. What is shown in FIG. 5 is an example in which intermediate voltage levels are obtained at a 1/5 pre-biased condition.

Figure 6:
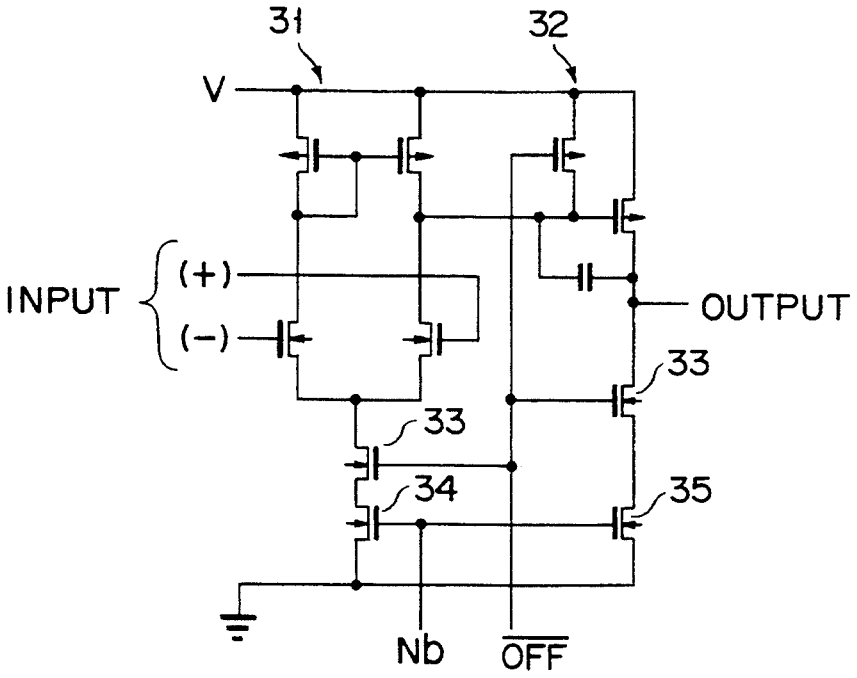
FIG. 6 and FIG. 7 are circuit diagrams respectively showing another examples of the operational amplifiers shown in FIG. 2 and FIG. 3.
Figure 7:
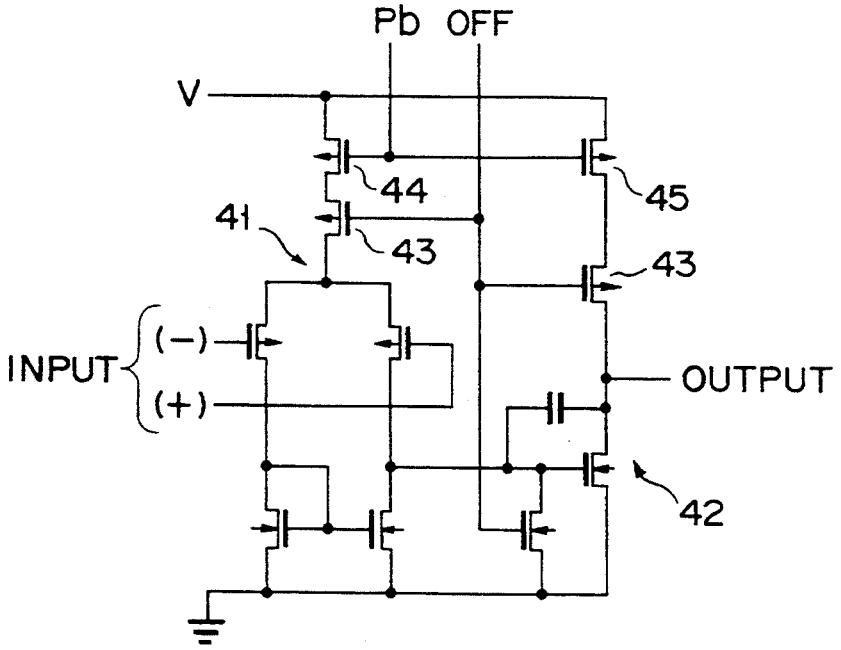

The structural examples of an operational amplifier in which an inactive state can be set in addition to those examples shown in FIG. 2 and FIG. 3 are shown in FIG. 6 and FIG. 7. In these figures, the parts corresponding to structural elements of FIGS. 2 and 3 are denoted by the same numerals.

Figures 8, 9:
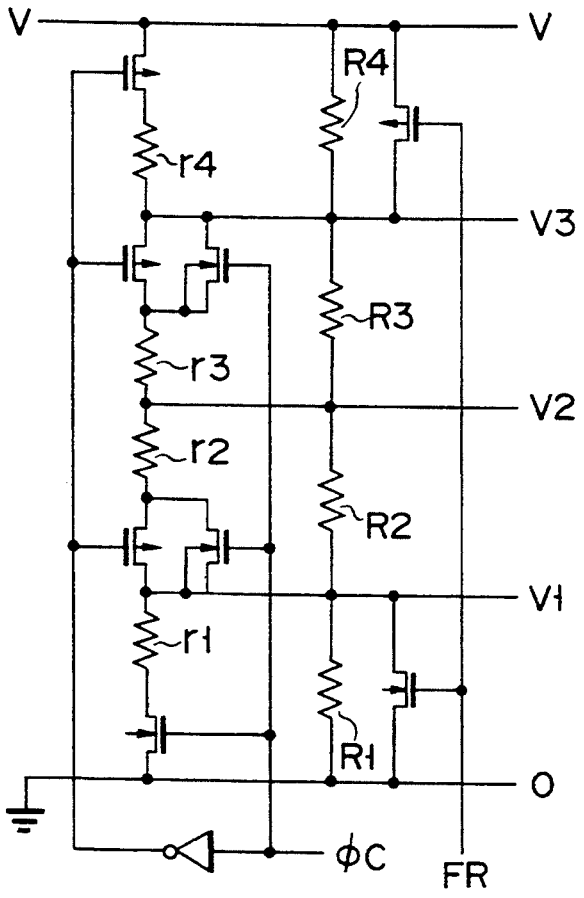
F I G. 8 (PRIOR ART)
F I G. 9 (PRIOR ART)
FIG. 8 is a circuit diagram for showing an example of the conventional power source circuit.
FIG. 9 is a table for explaining a voltage level generating condition of the circuit shown in FIG. 8.
Figure 13:
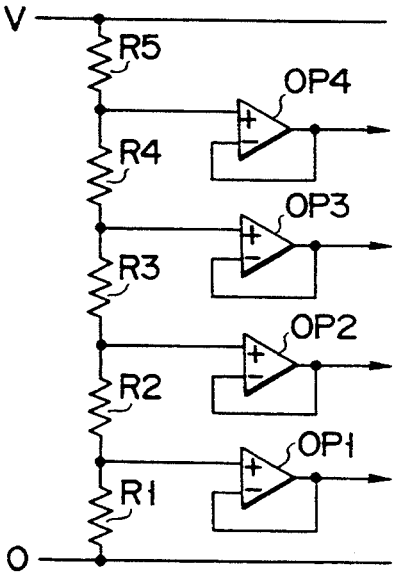
FIG. 13 (PRIOR ART)
FIG. 13 is a circuit diagram for showing another example of the conventional power source circuit.
Figure 12:
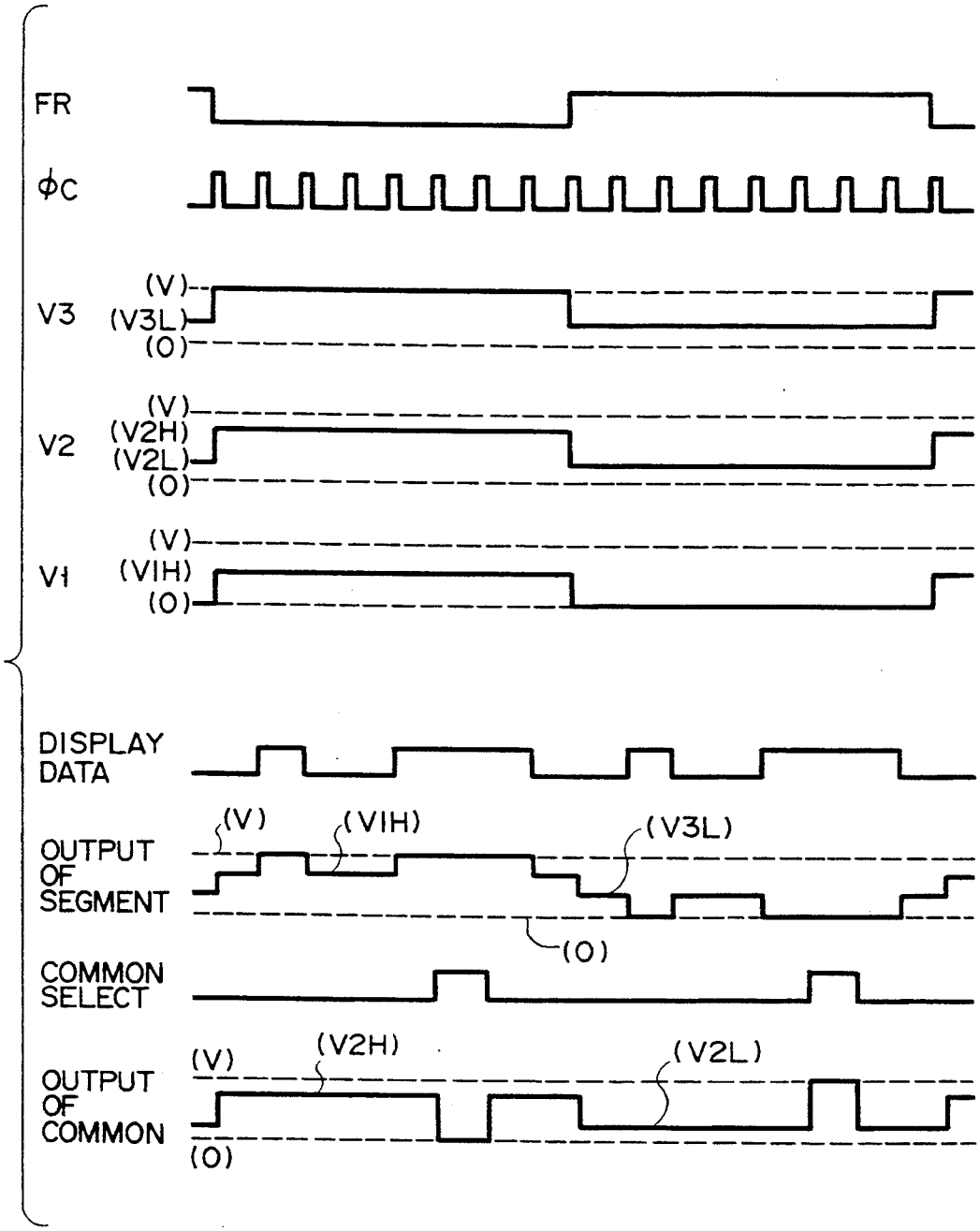
F I G. 12 (PRIOR ART)
FIG. 12 is a timing chart for explaining the condition of the liquid crystal driving power source voltage.

The power source device having the above structure makes it possible to obtain a display quality which is equal to that obtained by a liquid crystal driving power source circuit using as its buffers operational amplifiers OP1 to OP4 shown in FIG. 13, and to make its power consumption almost half of power consumption consumed by the circuit shown in FIG. 13. In a voltage dividing circuit shown in FIG. 8, at least four resistors (a group of r1, r4, R1 and R4, or a group of r2, r3, R2 and R3) must be simultaneously changed to change the pre-bias value to be applied to the liquid crystals, so that the amount of circuit elements will increase for performing a pre-bias value control by means of a software. In contrast, in a circuit shown in FIG. 1, the same purpose can be achieved only by changing a composite resistance value of resistors 13 to 15 using instruction signals B0 to B2. Therefore, the pre-bias value can be freely set by means of a software control function.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A power supply apparatus used for driving a liquid-crystal display and capable of producing a plurality of electrode-driving voltages of intermediate levels, said power supply apparatus comprising:

a voltage dividing circuit, including a plurality of resistors connected in series, for producing voltages of different intermediate levels V2H, V1H, V3L and V2L;

first to fourth operational amplifiers which are applied with the voltages of the intermediate levels V2H, V1H, V3L and V2L, respectively, said first to fourth operational amplifiers being classified into two groups in accordance with the intermediate levels of the voltages, one of said two groups including the first and second operational amplifiers, and the other of said two groups including the third and fourth operational amplifiers;

operational amplifier controlling means for controlling the first to fourth operational amplifiers by means of switching signals used for alternating-current-driving the liquid-crystal display, such that the operational amplifiers of one group and the operational amplifiers of the other group are selectively et in an active state and in an inactive non operating state; and driving voltage output means, connected to a segment electrode and a common electrode of the liquid-crystal display, for supplying outputs of the operational amplifiers of one group set in an active state to both the segment electrode and the common electrode, said operational amplifier control means producing switching signals alternately controlling a first group of said first and second operational amplifiers and a second group of said third and fourth operational amplifiers, such that each amplifier of one of said first and second groups is enabled to said active state while the other of said first and second groups is disabled to said inactive non operating state, corresponding to frame signals (FR) reversed for one frame.

2. An apparatus according to claim 1, wherein said voltage dividing circuit is formed of a plurality of resistors serially coupled with each other, those resistors that are arranged at a central portion of the plurality of resistors form a set of composite resistors, the plurality of resistors forming the composite resistors are each parallel coupled with a switching circuit, and a value of each of the composite resistors is variably set under control of the switching circuits.

3. An apparatus according to claim 1, wherein said voltage dividing circuit is formed of a first resistor, a second resistor, a third group of resistors, a fourth resistor, and a fifth resistor, all of which are serially connected with each other between the line for the maximum voltage level "v" and the line for the minimum voltage level "O", voltage outputs having intermediate voltage levels "V2H", "V1H", "V3L", and "V2L" are obtained from connecting points between each of the resistors and the group of resistors, and the voltage outputs are respectively supplied to the operational amplifiers.

4. An apparatus according to claim 3, wherein said group of resistors is formed of a plurality of resistors which are respectively parallel connected with switching circuits, a composite resistance value of the third group of resistors is determined under control of the switching circuits so that a pre-bias value is determined.

5. An apparatus according to claim 1, wherein said plurality of operational amplifiers are formed such that they are classified into a first group of operational amplifiers and a second group of operational amplifiers, first stage input portions of the first group of operational amplifiers are formed of N-channel MOSFETs, and first stage input portions of the second group of operational amplifiers are formed of P-channel MOSFETs.

6. An apparatus according to claim 1, wherein said operational amplifiers are set to be in an inactive state while power down signals for instructing a condition that a display function of the liquid crystal display device is not used are kept supplied.

7. An apparatus according to claim 1, further comprising a bias voltage generator for generating and supplying bias voltage to said operational amplifiers as bias voltage, the bias voltage generator is set to be in an inactive condition by the power down signal which is generated under a condition that a display function of the liquid crystal display device is not used.

8. A power supply apparatus used for driving a liquid-crystal display and capable of producing a plurality of electrode-driving voltages of intermediate levels, said power supply apparatus comprising:

a voltage dividing circuit including first to fifth resistors which are connected in series to form a series resistor circuit, said series resistor circuit being connected to a V-voltage line and a 0-volt voltage line at respective ends, so that voltages of intermediate levels V2H, V1H, V3L and V2L are produced from connection points between the first to fifth resistors, said third resistor having a group of resistor elements which are connected in series and which can be short-circuited to each other by means of a switching circuit;

first to fourth operational amplifiers which are connected to the respective connection points between the first to fifth resistors of the voltage dividing circuit and which are respectively applied with the voltages of intermediate levels V2H, V1H, V3L and V2L, said first and second operational amplifiers constituting a first group, and said third and fourth operational amplifiers constituting a second group;

operational amplifier control means for producing switching signals alternately controlling the first group of said first and second operational amplifiers and the second group of said third and fourth operational amplifiers, such that each amplifier of one of said first and second groups is enabled to an active state while the other of said first and second groups is disabled to an inactive non operating state, corresponding to frame signals (FR) reversed for one frame; and driving voltage output means for receiving a voltage signal from the operational amplifiers of one of the first and second groups which are set in the active state in response to an instruction from the operational amplifier control means, and for supplying the voltage signal to segment and common electrodes of the liquid crystal display.

* * * * *